United States Patent [19]

Truesdell et al.

[11] 4,150,518

[45] Apr. 24, 1979

[54] MULLION MOUNTING

[76] Inventors: Curtis A. Truesdell, 10676 W. Baker Rd.; Larry F. Wilson, 10621 Velma Dr., both of Greenville, Mich. 48838

[21] Appl. No.: 879,354

[22] Filed: Feb. 21, 1978

[51] Int. Cl.[2] ..... B65D 25/00

[52] U.S. Cl. ..... 52/804; 52/826; 220/434; 312/214

[58] Field of Search ..... 220/467, 430–434, 220/DIG. 3; 312/214; 52/627, 628, 629, 785, 717, 802, 804, 826; 24/73 BC, 73 MF, 81 CC; 49/487

[56] References Cited

U.S. PATENT DOCUMENTS

| | | | |
|---|---|---|---|
| 1,989,158 | 1/1935 | Seeger et al. | 220/432 |
| 2,266,893 | 12/1941 | Nauert | 220/434 |
| 2,464,526 | 3/1949 | Palmer | 220/432 |
| 2,480,257 | 8/1949 | Palmer et al. | 220/433 |
| 2,578,381 | 12/1951 | Tinnerman | 220/DIG. 3 |
| 2,750,065 | 6/1956 | Wallenbrock | 220/432 |
| 2,855,636 | 10/1958 | Donnelly | 220/434 X |
| 3,261,139 | 7/1966 | Bond | 52/823 X |
| 4,091,593 | 5/1978 | Mennuto | 52/785 |

*Primary Examiner*—William Price
*Assistant Examiner*—Allan N. Shoap
*Attorney, Agent, or Firm*—Strauch, Nolan, Neale, Nies & Kurz

[57] ABSTRACT

Apparatus for securing a trim strip or mullion to two adjacent wall panels. The apparatus is particularly useful in securing a mullion to the forward edges of the adjacent portions of the liners of the fresh food and frozen food compartments of a side-by-side refrigerator.

5 Claims, 6 Drawing Figures

MULLION MOUNTING

BACKGROUND OF THE INVENTION

One currently popular style of household refrigerator, called a side-by-side, comprises vertically disposed compartments, one compartment being maintained at a below freezing temperature for the storage of frozen food and the other compartment being maintained at an appropriate above freezing temperature for the storage of fresh foods.

Often the compartments are provided with individual liners and the vertical insulating divider wall separating the compartments is formed by the adjacent spaced apart wall portions of the two compartment liners. The forward edge of the divider wall is formed by a mullion or trim strip which extends from top to bottom of the refrigerator and bridges the space between the front edges of the two adjacent liners. The entire refrigerator cabinet including the central vertical dividing wall is insulated by a method termed "foam in place" which comprises injecting a suitable plastic in liquid form through the rear surface of the refrigerator which expands and flows in and around the liner structure to provide the necessary insulation.

To assure the penetration of the foam to all regions of the refrigerator cabinet where insulation is required, moderately high pressures must be developed during the foaming process. Accordingly, it is essential that all portions of the refrigerator be leak proof to prevent the escape of foam during the foaming process.

A particular problem has been encountered in suitably sealing the mullion strip which forms the front edge of the central vertical divider wall. Prior proposals such as the use of special adhesives, spacers and the like have proved to be generally unsatisfactory either because they failed to provide the required seal or because they were difficult to install or because of cost factors.

SUMMARY OF THE INVENTION

With the foregoing considerations in mind it is a principal purpose and object of the present invention to provide improved retainer means for securing a mullion or trim strip to the forward edge of the central divider wall in a side-by-side refrigerator, the retainer providing secure leakproof attachment of the parts, being of low cost construction and eliminating the need for special assembly techniques.

In attaining this and other objects the present invention provides a two part clip or a retainer construction, one part of the clip being frictionally attached to the mullion strip and the second part being frictionally attached to the first part. The construction thus eliminates the need for adhesives, welding or spot riveting.

The clip or retainer construction also locates the hot gas line which is usually provided around the front edge of the divider wall to prevent condensation at this region. Additionally, the clip construction locates and grips the adjacent portions of the front edges of the liner walls to perform the dual function of firmly attaching the mullion to the liner walls and simultaneously maintaining the proper spacing between the liners.

Additional objects and advantages of the present invention will become apparent as the description proceeds in connection with the accompanying drawings.

THE DRAWINGS

DESCRIPTION OF PREFERRED EMBODIMENTS

Figure 1:
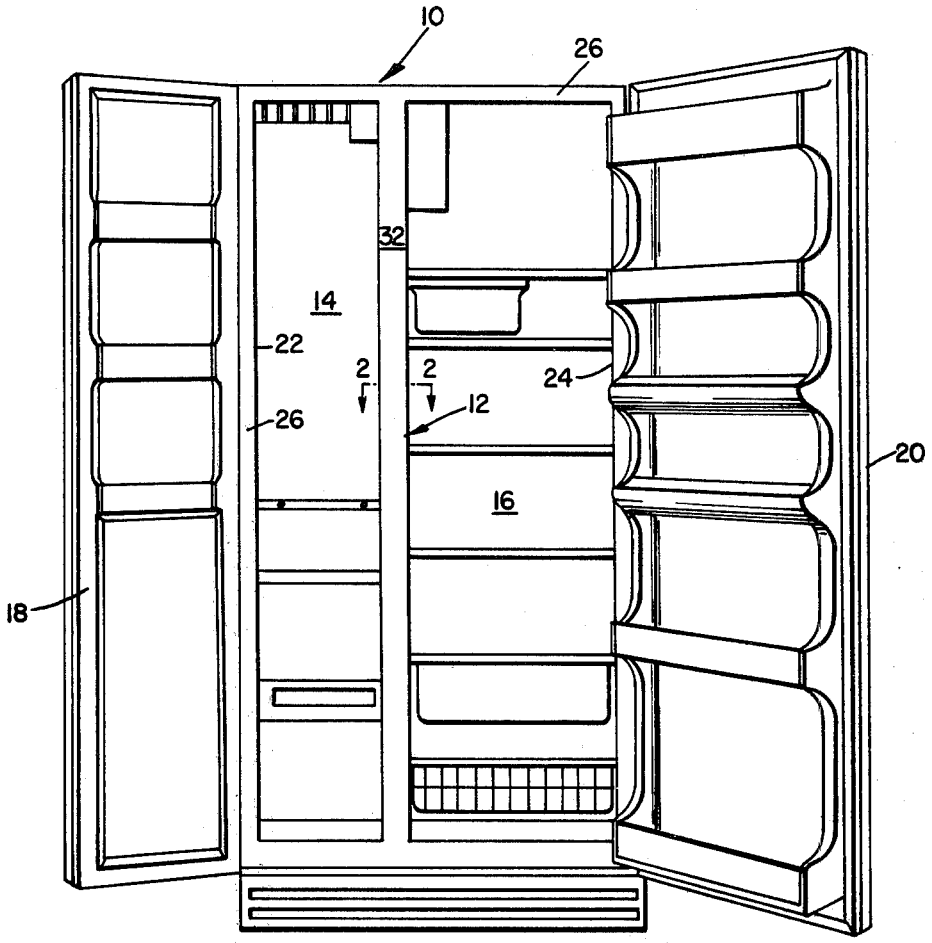
FIG. 1 is a perspective view of a typical side-by-side refrigerator incorporating the present invention.

Referring now more particularly to the drawing, the side-by-side refrigerator of FIG. 1 illustrates a typical application in which the present invention has achieved special utility. Except for the mullion and its attachment to the remainder of the structure, the refrigerator may be of conventional construction and comprises an outer cabinet 10, the interior of which is separated by a vertical divider wall 12 into a frozen food compartment 14 and a fresh food compartment 16. As is conventional the compartments are closed by separate doors 18 and 20. In accordance with conventional practice the interior of the fresh food cabinet and the frozen food cabinet are formed by one piece liners 22 and 24, respectively. The liners are secured in suitably spaced relation to the main outer cabinet and to each other by breaker strips 26 which may be of conventional construction and need not be described in further detail here.

The present invention is primarily concerned with the trim strip or mullion 32 which forms the front edge of the central divider wall and its means of attachment to the two liners 22 and 24. This structure will now be described in greater detail with reference to FIGS. 2–6.

The retainer assembly comprises first and second clips indicated generally at 34 and 36, respectively, connected by a single stud 38 as described below.

The clip 34, which in a typical case is fabricated from 0.017 spring steel and is ¾ inch long and 1 13/32 inches wide comprises an essentially flat body portion 40 terminating at its opposite edges in upturned flanges 42.

The flanges 42 are dimensioned to fit snugly within the corresponding inturned edges 44 of the mullion 32. Adjacent their opposite ends the flanges 42 are provided with sharp projections or tangs 46, which, when the clip 34 is installed in the mullion 32 by pressing it into place, effectively retain the clip in place and prevent its dislodgement or vertical displacement. A central opening 48 is provided in the main body of the clip 34 to receive the body of the stud 38, the stud being held in place by an enlarged head 50 which is effectively clamped between the clip 34 and the mullion 32.

The secondary clip 36, which is typically formed of heavier material, such as 0.026 spring steel and which may be formed in a single stamping operation, is of essentially U-shaped configuration having a flat base portion 52 and legs 54 which terminate in outturned flange portions 56. The main body portion of the clip is formed with a longitudinal slot 58 and transverse slots 60 to impart a slight flexibility to the body portions running along the slot 58 which is of slightly less width than the body of the stud 38. Accordingly when the clip 36 is pressed onto the stud the margins of the slot 58 firmly grip the stud to lock the clip 36 securely on the stud.

Figure 2:
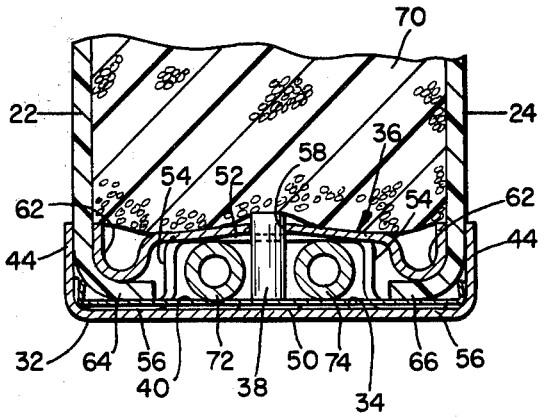
FIG. 2 is an enlarged fragmentary section taken along line 2—2 of FIG. 1.
Figure 3:
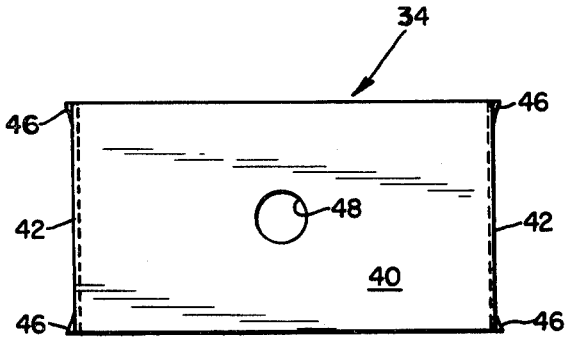
FIGS. 3 and 4 are plan and side views of one element of the retainer construction of the present invention.
Figure 4:
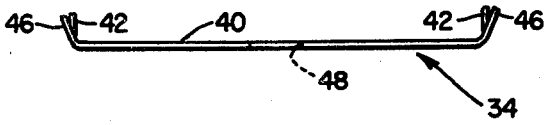
Figure 5:
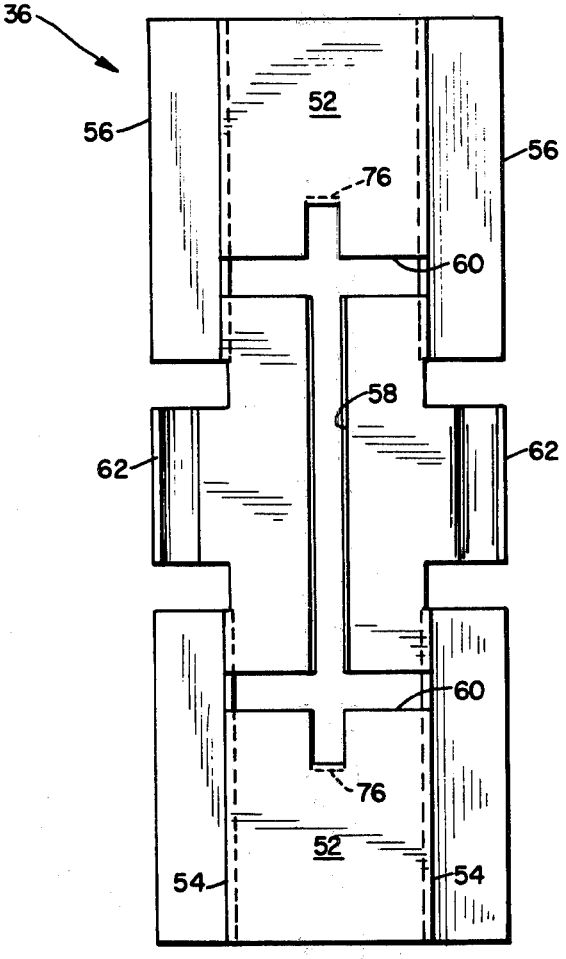
FIGS. 5 and 6 are similar views of another element of the retainer construction.
Figure 6:
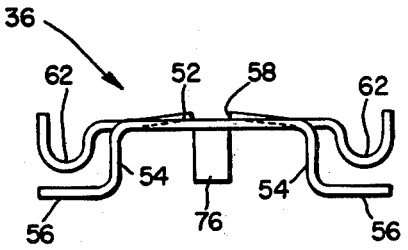

The flanges 56 are interrupted intermediate their ends to provide secondary raised flanges 62. As best shown in FIG. 2 the spacing between the flanges 62 and the flanges 56 is just sufficient to frictionally grip the inturned end portions 64 and 66 of the liner walls 22 and 24. As shown, the outer margins of the raised flanges 62 are curved to match the contour of the adjacent portions of the liner.

To provide additional security against leakage of the foam insulation a block 70 of foam material such as polyester or polyurethane is positioned inwardly of the retainer construction and extends the full height of the divider wall.

When the refrigerator is otherwise ready for the application of the foam insulation, the barrier strip 70 is installed and preferably held in position against one of the liners 22 or 24 by cement. The clips 36 are then installed at selected spaced points along the length of the liners typically at three or four locations. The hot gas lines 72 and 74 are then laid in place as shown in FIG. 2. These lines are held in proper spaced parallel relation and are retained against outward movement by the legs 54 and held against inward movement by tabs 76 struck inwardly from the ends of the slot 58.

The clips 34 are then installed by pressing them into place in the mullion 32, the number and spacing of the clips 34 being the same as the number and spacing of the clips 36. However, exact correspondence between the spacing of the clips 34 and 36 is not essential since the stud 38 can be accommodated anywhere along the length of the slots 58 in the clips 36. The mullion is then installed by simply pressing it into place, the gripping action exerted by the edges of the slot 58 on the studs 38 holding the parts firmly in assembled relation. The assembly is then ready for foaming.

It will be noted that the liner walls are firmly held against inward movement by the clip flanges 62 and firmly held against outward movement by the mullion flanges 44. The gas lines 72 and 74 are held in their proper spaced parallel positions as previously described.

Actual experience has shown that the retainer construction thus far described is of low cost, easy to install, and provides an effective, reliable sealing connection between the mullion and the liner walls while at the same time holding all of the parts in their proper relation. It is also to be noted that the retainer construction is completely invisible and requires no welding, adhesives, or spot riveting as was common in prior designs.

We claim:

1. Means for attaching an outer U-shaped strip to bridge the space between the edges of two essentially parallel spaced apart wall structures having inturned end flanges at their outer extremities, said end flanges being essentially perpendicular to said wall structures comprising: first clip means secured to said strip, second clip means having spaced apart leg portions extending essentially perpendicular to said wall structures and engageable, respectively, with the inner and outer surfaces of said inturned end flanges of said wall structures to thereby retain said second clip means against movement in a direction parallel to said wall structures, and connecting means carried by one of said clip means and frictionally engageable with the other clip means to hold said first and second clip means in assembled relation to thereby retain said cover strip in bridging relation to said wall structures, and said strip having side flanges engageable with said wall structures to hold said wall structures against movement away from each other.

2. The combination according to claim 1, wherein said cover strip is a mullion and said wall structures are refrigerator liners.

3. The combination according to claim 2 wherein said first clip means is frictionally secured to said mullion.

4. The combination according to claim 2 wherein said first clip means is frictionally secured to said mullion and said connecting means comprises a stud carried by said first clip means and extending through an opening in said second clip means for frictional engagement thereby.

5. Means for attaching a U-shaped mullion to bridge the space between two essentially parallel spaced apart refrigerator liners having inturned end flanges at their outer extremities comprising a plurality of first clip means frictionally secured to the inner surface of said mullion at spaced points along the length thereof, a plurality of second clip means secured to said liners, the number and spacing of said second clip means corresponding to the number and spacing of said first clip means, said second clip means having spaced apart leg portions engageable with the inner and outer surfaces of said inturned end flanges of said liners and operable to determine the minimum spacing between said liners, connecting means carried by each of said first clip means frictionally engageable with respective ones of said second clip means to hold said first and second clip means in assembled relation to thereby retain said mullion in bridging relation to said liners, and said mullion having side flanges engageable with said liners to hold said liners against movement away from each other.

* * * * *